US010036139B2

(12) United States Patent
French et al.

(10) Patent No.: US 10,036,139 B2
(45) Date of Patent: Jul. 31, 2018

(54) MACHINE INPUT DEVICE HAVING MULTI-AXIS TOOL CONTROL

(71) Applicant: Caterpillar Inc., Peoria, IL (US)

(72) Inventors: Nathan Daniel French, Metamora, IL (US); Andrew John Kieser, Morton, IL (US); Tony Ross Metzger, Congerville, IL (US); Bryan Everett Copeland, Bartonville, IL (US); David Allen Ober, Peoria, IL (US); Brad R. Van De Veer, Washington, IL (US)

(73) Assignee: Caterpillar Inc., Deerfield, IL (US)

( * ) Notice: Subject to any disclaimer, the term of this patent is extended or adjusted under 35 U.S.C. 154(b) by 674 days.

(21) Appl. No.: 14/552,105

(22) Filed: Nov. 24, 2014

(65) Prior Publication Data

US 2016/0145828 A1 May 26, 2016

(51) Int. Cl.

| | |
|---|---|
| ***E02F 3/84*** | (2006.01) |
| ***G05G 1/04*** | (2006.01) |
| ***E02F 9/20*** | (2006.01) |
| ***E02F 9/22*** | (2006.01) |

(52) U.S. Cl.

CPC ..... *E02F 3/844* (2013.01); *E02F 9/2004* (2013.01); *E02F 9/2296* (2013.01); *G05G 1/04* (2013.01)

(58) Field of Classification Search

CPC ..... E02F 3/84; E02F 3/844; E02F 9/2004
USPC ..... 463/38
See application file for complete search history.

(56) References Cited

U.S. PATENT DOCUMENTS

| | | | | |
|---|---|---|---|---|
| 5,277,258 | A | 1/1994 | O'Dell | |
| D351,625 | S * | 10/1994 | Carter | D14/416 |
| 5,620,053 | A | 4/1997 | Kamikawa et al. | |
| H001822 | H * | 12/1999 | Kelley | 180/333 |
| 6,068,554 | A * | 5/2000 | Tyler | G05G 9/047 345/161 |
| 6,148,593 | A * | 11/2000 | Heinsey | G05G 1/01 56/1 |
| 6,152,239 | A * | 11/2000 | Kelley | E02F 3/841 172/4.5 |
| 7,275,616 | B2 * | 10/2007 | Link | A01D 41/127 180/333 |
| 7,334,658 | B2 | 2/2008 | Berg et al. | |

(Continued)

OTHER PUBLICATIONS

U.S. Appl. No. 29/509,961 entitled "Controller" filed Nov. 24, 2014.

*Primary Examiner* — Matthew D. Troutman
(74) *Attorney, Agent, or Firm* — Finnegan, Henderson, Farabow, Garrett & Dunner, LLP; James S. Bennin

(57) ABSTRACT

An input device is disclosed for use with a machine having a work tool. The input device may have a handle with proximal and distal ends. The input device may also have a proportional control element located at the distal end, and configured to pivot in a first direction to generate a first signal and to pivot in a second direction to generate a second signal. The work tool may have a first axis of rotation that is generally horizontal relative to a ground surface and generally perpendicular relative to a travel direction, and a second axis of rotation that is generally vertical relative to the ground surface and generally perpendicular relative to the first axis. The first signal may be indicative of a desire to pitch the work tool about the first axis, and the second signal may be indicative of a desire to yaw the work tool about the second axis.

20 Claims, 3 Drawing Sheets

(56) References Cited

U.S. PATENT DOCUMENTS

| | | | | |
|---|---|---|---|---|
| 7,497,298 | B2 * | 3/2009 | Shearer | E02F 3/7663 180/333 |
| 7,681,686 | B1 * | 3/2010 | Klas | B60K 26/00 180/329 |
| 7,784,581 | B1 * | 8/2010 | Klas | B60N 2/4693 180/329 |
| 8,434,562 | B2 | 5/2013 | Miyasaka et al. | |
| 8,700,271 | B2 | 4/2014 | Evanson et al. | |
| 2008/0184841 | A1 * | 8/2008 | Blind | A01B 63/00 74/491 |
| 2012/0152575 | A1 | 5/2012 | Hand et al. | |

* cited by examiner

MACHINE INPUT DEVICE HAVING MULTI-AXIS TOOL CONTROL

TECHNICAL FIELD

The present disclosure relates generally to an input device for a machine, and more particularly, to an operator input device having multi-axis control over a tool of the machine.

BACKGROUND

Some earth moving machines, for example dozers, motor graders, wheel loaders, and snow plows, have a front-mounted work tool such as a blade, bucket, or plow for pushing or carrying material. These work tools can be tilted about a first horizontal axis that is generally perpendicular to the work tool (i.e., aligned with a travel direction), pitched about a second horizontal axis that is generally parallel to the work tool, and lifted relative to a ground surface. Tilting can be accomplished by extending a hydraulic cylinder located at a first side of the work tool, while simultaneously retracting a hydraulic cylinder located at an opposing side of the work tool. Pitching can be accomplished by extending or retracting both hydraulic cylinders in the same direction at the same time. Lifting of the work tool can be accomplished through extension of a separate lift cylinder. Existing hydraulic systems utilize different combinations of input devices to regulate the tilting, pitching, and lifting operations.

An exemplary hydraulic system is disclosed in U.S. Patent Publication No. 2012/0152575 of Hand et al. that published on Jun. 1, 2012 (the '575 publication). Specifically, the '575 publication discloses a hydraulic system having left and right cylinders capable of tilting and pitching a work tool, and an input device for control over the left and right cylinders. The input device includes an inwardly-inclined handle (relative to an operator seat) that is pivotal in a vertical plane about a horizontal axis. When the handle is pivoted to the left or right, a signal is generated indicative of desired tilting of the work tool. A thumb roller is located at a gripping end of the handle and, when rotated about its axis, generates a signal indicative of desired pitching of the work tool.

Although the input device of the '575 publication may be capable of implementing tilt and pitch operations, it can still be improved upon. That is, the input device of the '575 publication may not be intuitive for all users and/or not include functionality required for some applications.

The input device of the present disclosure addresses one or more of the needs set forth above and/or other problems of the prior art.

SUMMARY

In one aspect, the present disclosure is directed to an input device for a machine having a work tool. The input device may include a handle with a proximal end connectable to the machine, and a distal end. The input device may also include a proportional control element located at the distal end of the handle, and configured to pivot in a first direction to generate a first signal and to pivot in a second direction generally orthogonal to the first direction to generate a second signal. The work tool may have a first axis of rotation that is generally horizontal relative to a ground surface under the machine and generally perpendicular relative to a travel direction of the machine, and a second axis of rotation that is generally vertical relative to the ground surface and generally perpendicular relative to the first axis. The first signal from the input device may be indicative of a desire to pitch the work tool about the first axis of rotation, and the second signal may be indicative of a desire to yaw the work tool about the second axis of rotation.

In another aspect, the present disclosure is directed to another input device for a machine having a work tool. This input device may include a handle having a proximal end connectable to the machine and a distal end, and being configured to pivot in a first direction to generate a first signal and to pivot in a second direction generally orthogonal to the first direction to generate a second signal. The input device may also include a rocker button located at the distal end of the handle, and configured to pivot in a third direction to generate a third signal and to pivot in a fourth direction generally orthogonal to the third direction to generate a fourth signal. The work tool may have a first axis of rotation that is generally horizontal relative to a ground surface under the machine and generally perpendicular relative to a travel direction of the machine, and a second axis of rotation that is generally vertical relative to the ground surface and generally perpendicular relative to the first axis. The work tool may also have a third axis of rotation that is generally horizontal relative to the ground surface and generally perpendicular relative to the first and second axes. The first signal from the input device may be indicative of a desire to roll the work tool about the third axis of rotation. The second signal may be indicative of a desire to elevate the work tool relative to the ground surface. The third signal may be indicative of a desire to pitch the work tool about the first axis of rotation. The fourth signal may be indicative of a desire to yaw the work tool about the second axis of rotation.

In another aspect, the present disclosure is directed to a machine. The machine may include a frame, and a work tool pivotally connected to the frame. The machine may also include at least a first cylinder configured to elevate the work tool relative to the frame, at least a second cylinder configured to yaw the work tool relative to the frame, a third cylinder configured to pitch the work tool relative to the frame, and a fourth cylinder configured to roll the work tool relative to the frame. The machine may also include an operator station supported by the frame, and an input device located inside the operator station. The input device may have a handle with a proximal end connectable to the machine and a distal end, and be configured to pivot in a first direction to generate a first signal indicative of a desire to actuate the at least a first cylinder and to pivot in a second direction generally orthogonal to the first direction to generate a second signal indicative of a desire to actuate the fourth cylinder. The input device may also have a rocker button located at the distal end of the handle, and configured to pivot in a third direction to generate a third signal indicative of a desire to actuate the at least a second cylinder and to pivot in a fourth direction generally orthogonal to the third direction to generate a fourth signal indicative of a desire to actuate the third cylinder.

DETAILED DESCRIPTION

Figure 1:
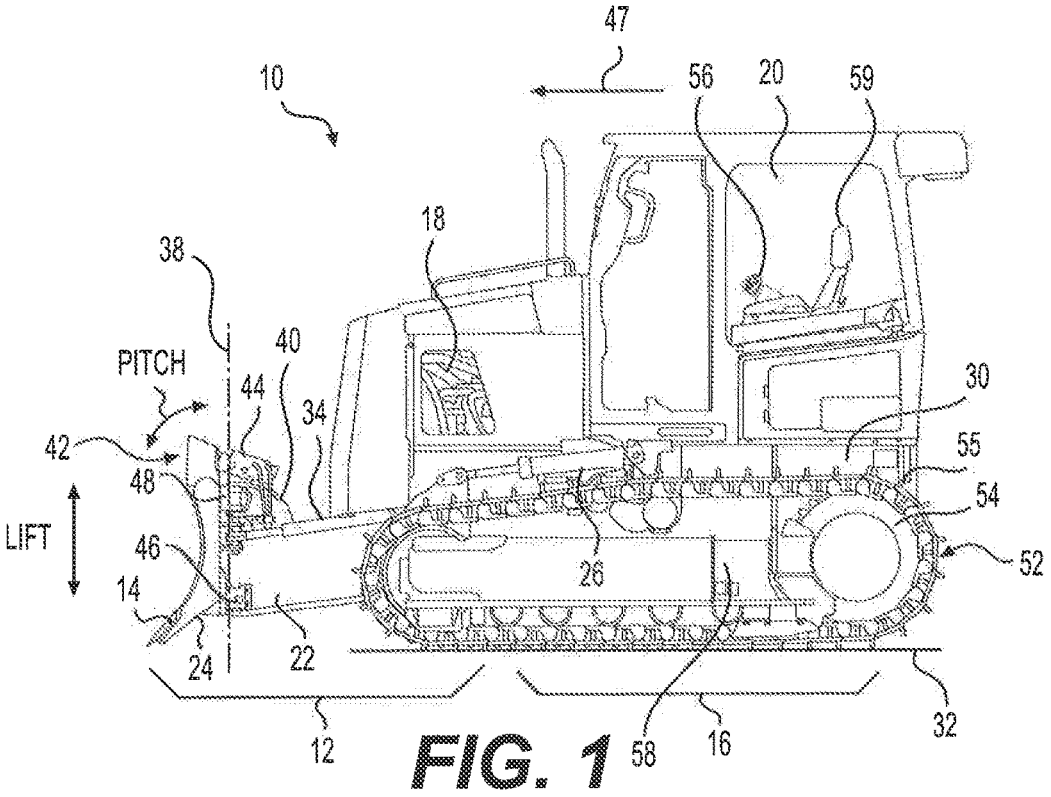
FIGS. 1 and 2 are side and top view pictorial illustrations of an exemplary disclosed machine, respectively.
Figure 2:
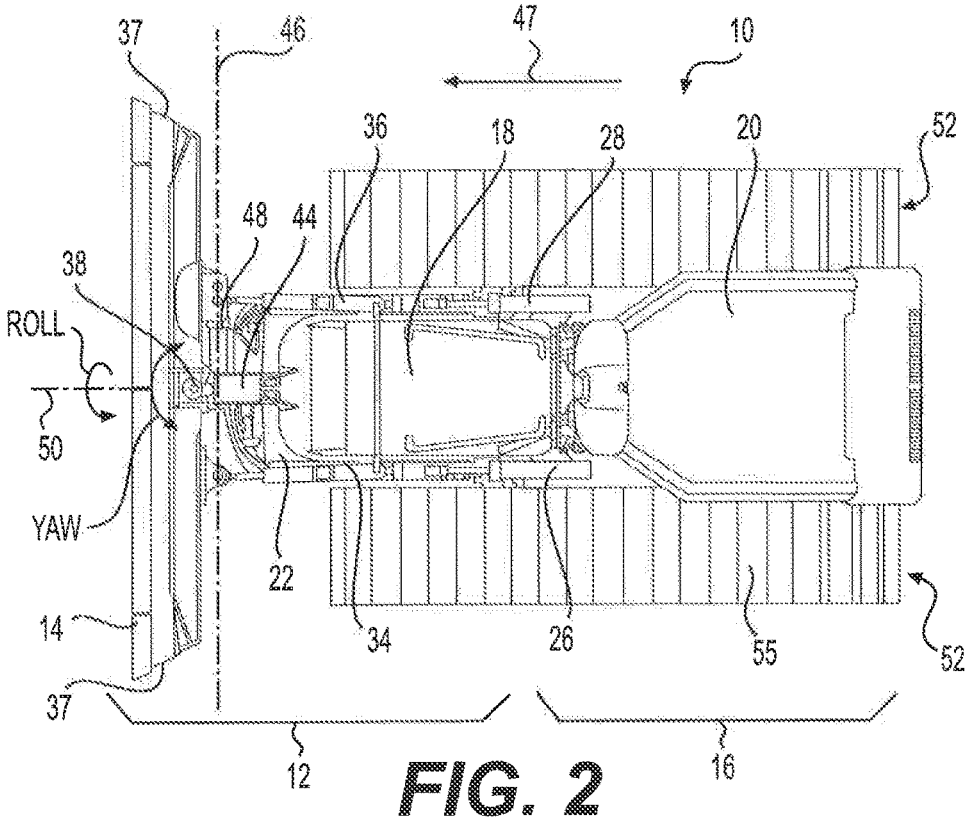

FIGS. 1 and 2 illustrate an exemplary machine 10 having multiple systems and components that cooperate to accomplish a task. Machine 10 may embody a mobile machine that performs some type of operation associated with an industry such as mining, construction, farming, transportation, or another industry known in the art. For example, machine 10 may be a material moving machine such as a dozer, a motor grader, a wheel loader, a snow plow, or similar machine. Machine 10 may include an implement system 12 configured to move a work tool 14, a drive system 16 for propelling machine 10, a power source 18 that provides power to implement system 12 and drive system 16, and an operator station 20 that provides for control of implement system 12, drive system 16, and/or power system 18.

Implement system 12 may include a linkage structure acted on by fluid actuators to move work tool 14. Specifically, implement system 12 may include a generally C-shaped push frame 22 that is pivotally connected at opposing ends to drive system 16 and at a center to a lower edge 24 (shown only in FIG. 1) of work tool 14. A first pair of left and right hydraulic cylinders (lift cylinder) 26, 28 may pivotally connect legs of frame 22 to a machine frame 30, and be functional to raise and lower work tool 14 relative to a ground surface 32. A second pair of left and right hydraulic cylinders (yaw cylinders) 34, 36 may pivotally connect the legs of push frame 22 to opposing side edges 37 of work tool 14, and be functional to yaw work tool 14 about a vertical axis 38. An arm 40 may extend vertically upward away from the center of push frame 22 toward an upper edge 42 of work tool 14, and a hydraulic cylinder (pitch cylinder) 44 may pivotally connect a distal tip of arm 40 to upper edge 42. Pitch cylinder 44 may be functional to pitch work tool 14 about a horizontal axis 46 that is generally perpendicular to axis 38 and to a travel direction 47 of machine 10. An additional hydraulic cylinder (roll cylinder) 48 may extend from the tip end of arm 40 to a point of on work tool 14 located between arm 40 and side edge 37. Roll cylinder 48 may be functional to roll work tool 14 about a horizontal axis 50. Axis 50 may be generally aligned with the travel direction of machine 10, and orthogonal to axes 38 and 46.

Numerous different work tools 14 may be attachable to a single machine 10 and operator controllable. Work tool 14 may include any device used to perform a particular task such as, for example, a blade, a bucket, a plow, or another task-performing device known in the art. Although connected in the embodiment of FIG. 1 to pivot in the vertical and horizontal directions relative to frame 30 of machine 10 and to lift relative to ground surface 32, work tool 14 could additionally slide, swing, open and close, or move in another manner known in the art.

Drive system 16 may include opposing undercarriage assemblies 52 (only one shown in FIG. 1), each having a sprocket 54 driven by power source 18 to rotate a corresponding endless track 55. Each undercarriage assembly 52 may also include a base member 58 (shown only in FIG. 1) operatively connected to sprocket 54 and/or frame 30 to support the ends of push frame 22. It is contemplated that drive system 16 could alternatively include traction devices other than tracks 55, if desired, such as wheels, belts, or other known traction devices.

Power source 18 may embody an engine such as, for example, a diesel engine, a gasoline engine, a gaseous fuel-powered engine, or any other type of combustion engine known in the art. It is contemplated that power source 18 may alternatively embody a non-combustion source of power such as a fuel cell, a power storage device, or another known source. Power source 18 may produce a mechanical or electrical power output that is used to propel machine 10 via drive system 16 and that can be converted to hydraulic power for moving hydraulic cylinders 26, 28, 34, 36, 44, 48.

Operator station 20 may include devices that receive input from a machine operator indicative of desired machine maneuvering. Specifically, operator station 20 may include one or more input devices 56 (shown in FIGS. 1, 3, and 4) located proximate a seat 59 (shown only in FIG. 1). Input devices 56 may be manipulated by an operator to initiate movement of machine 10 by producing proportional displacement signals that are indicative of desired maneuvering. In the disclosed embodiment, input device 56 is a joystick associated with control of lifting, pitching, rolling, and yawing movements of work tool 14. It is contemplated that input devices 56 other than a joystick such as, for example, a pedal, a lever, a wheel, and other devices known in the art, may additionally be provided within operator station 20 for movement control of machine 10, if desired.

Figure 3:
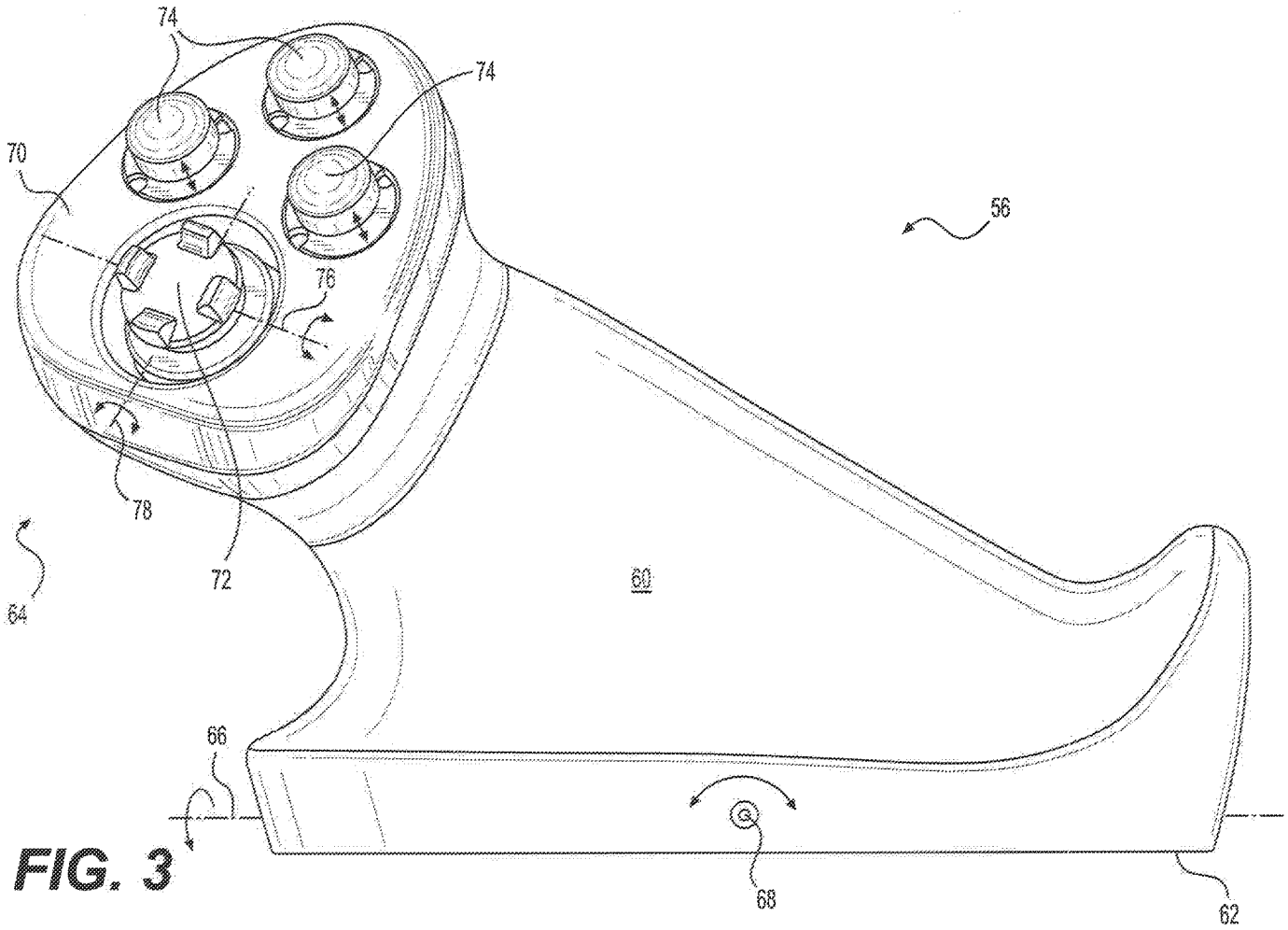
FIG. 3 is a pictorial illustration of an exemplary disclosed input device that may be used in conjunction with the machine of FIGS. 1 and 2.

As shown in FIG. 2, input device 56 may include a handle 60 having a proximal end 62 connected to machine 10 inside operator station 20, and a distal end 64 that cantilevers inward relative to seat 59. In one embodiment, proximal end 62 is connected to an armrest of seat 59, such that the operators arm may be supported by the armrest with the hand of the operator lying on handle 60. The configuration shown in FIG. 3 is intended for use by the right hand of the operator, such that the operator's thumb may encircle the lower-left portion of handle 60 and the operator's fingers may pass over handle 60. In this configuration, the thumb may quickly be moved to distal end 64 to access additional control features located at distal end 64. It should be noted that the geometry of input device 56 could be mirrored left-to-right across a vertical plane (not shown), if desired, such that the operator could manipulate input device 56 with the left hand.

Handle 60 may pivot in at least two directions that are generally orthogonal to each other. In particular, handle 60 may pivot fore-and-aft about a first horizontal axis 66 and pivot left-and-right about a second horizontal axis 68. In the disclosed embodiment, the fore/aft pivoting of handle 60 may be generally aligned with the travel direction 47 (shown in FIG. 1) of machine 10, and handle 60 may be normally oriented at an oblique angle relative to the pivoting directions. When handle 60 is pivoted about axis 66, a first proportional signal may be generated indicative of desired lifting of work tool 14 by lift cylinders 26, 28. When handle 60 is pivoted about axis 68, a second proportional signal may be generated indicative of desired rolling of work tool 14 by roll cylinder 48. In some embodiments, handle 60 may be simultaneously pivoted about both of axis 66 and 68 to thereby generate a composite signal indicative a desire to simultaneously lift and roll work tool 14. Handle 60 may be spring-centered (i.e., biased to a neutral position) relative to one or both of axis 66 and 68.

One or more additional control devices may be located at distal end 64 of handle 60, and associated with movement of work tool 14. Specifically, handle 60 may be generally cylindrical and, inserted within an end face 70 of the cylindrical shape, may be a proportional control element 72 and one or more momentary control elements 74. In the disclosed embodiment, proportional control element 72 may be a rocker button located gravitationally lower than momentary control elements, while momentary control elements 74 may be linear push buttons arranged in a generally triangular configuration. It is contemplated that additional and/or different types of control elements may be included within input device 56, if desired.

Proportional control element 72, as a rocker button, may pivot in at least two directions. For example, control element 72 may pivot in a fore-and-aft direction about an axis 76 and in a left-and-right direction about an axis 78. When control element 72 is pivoted about axis 76, a third proportional signal may be generated indicative of desired pitching of work tool 14 by pitch cylinder 44. When control element 72 is pivoted about axis 78, a fourth proportional signal may be generated indicative of desired yawing of work tool 14 by yaw cylinders 34 and 36. In some embodiments, control element 72 may be simultaneously pivoted about both of axis 76 and 78 to thereby generate a composite signal indicative a desire to simultaneously pitch and yaw work tool 14. Control element 72 may be spring-centered (i.e., biased to a neutral position) relative to one or both of axes 76 and 78.

Momentary control elements 74 may be associated with any known function(s) of machine 10 and work tool 14 that require operator input. In the disclosed example, control elements 74 are associated with work tool movement. For example, one of momentary control elements (e.g., the left-most element shown in FIG. 3) 74 could be associated with a tool shake function. In this example, when this particular element 74 is depressed, any one or more of cylinders 26, 28, 34, 36, 44, 48 may be rapidly extended and retracted by a desired amount to cause shaking of work tool 14. This function may be selectively activated to shake off any material stuck to work tool 14. In one embodiment, the shaking of work tool 14 may continue as long as the corresponding control element 74 is depressed by the operator. In another embodiment, depressing the control element 74 once may initiate shaking, and depressing the control element a second time may terminate shaking.

In the same or another example, one or more of control elements 74 could be associated with a tracked grading operation. In particular, in some embodiments, the movements of work tool 14 may be automatically tracked and controlled based on a desired contour of ground surface 32. Specifically, work tool 14 could be automatically lifted, pitched, rolled, and/or yawed such that an actual contour of ground surface 32 substantially matches a desired virtual contour. In this example, the automated tracking and moving of work tool 14 may be initiated, adjusted, and/or terminated using one or more of control elements 74 (e.g., the upper and right elements 74). It is contemplated that these control elements 74 could be used for other or additional purposes, if desired.

Figure 4:
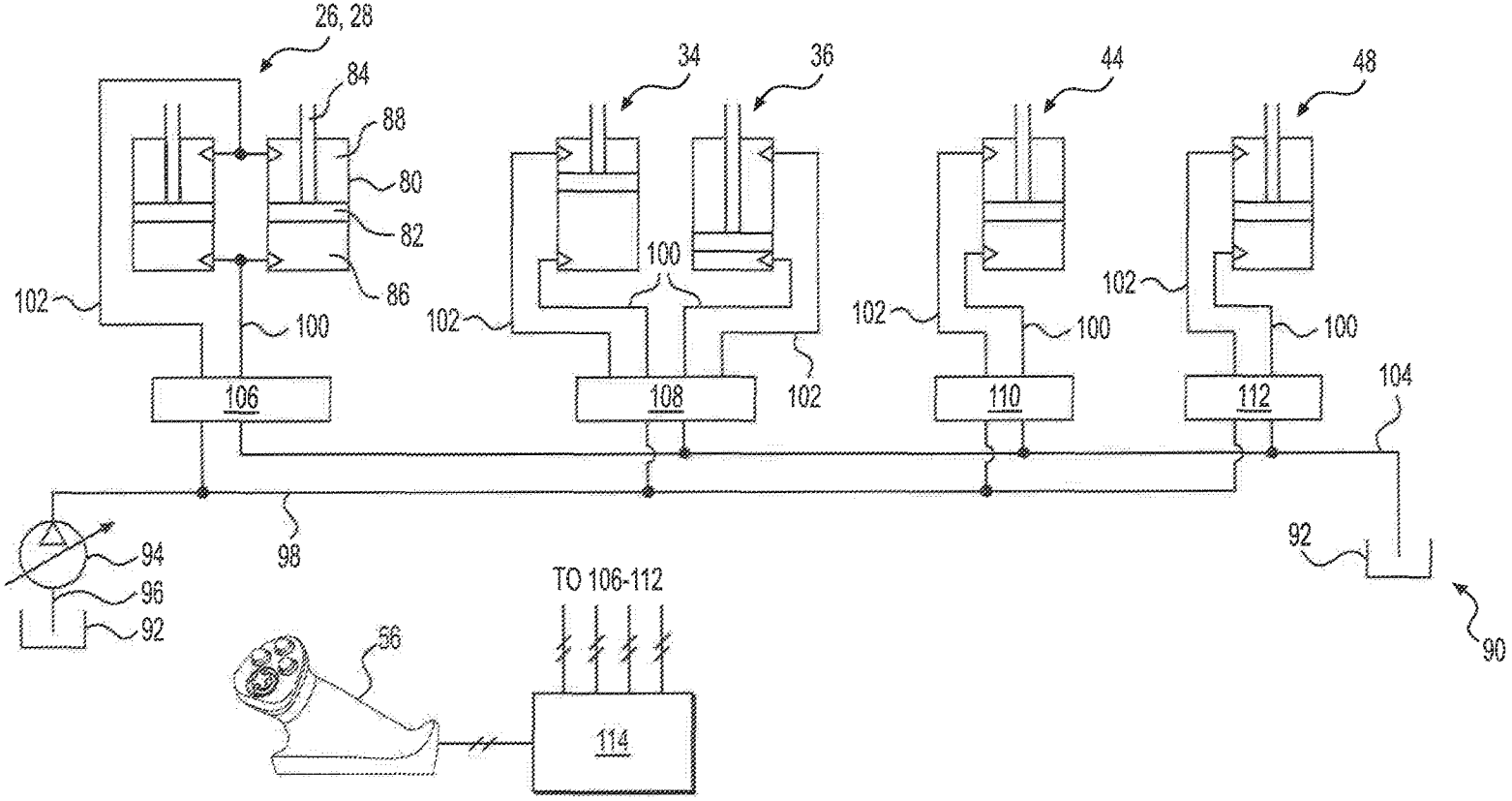
FIG. 4 is a schematic illustrating an exemplary disclosed hydraulic system associated with the machine and input device of FIGS. 1-3.

As shown in FIG. 4, each of hydraulic cylinders 26, 28, 34, 36, 44, 48 may include a tube 80 having a closed end operatively connected to a support member (e.g., to push frame 22, machine frame 30, arm 40—referring to FIG. 1), and a piston assembly 82 having a rod 84 protruding through an open end of tube 80 for connection to work tool 14 (or in the case of lift cylinders 26, 28, for connection to push frame 22). Piston assembly 82 may be arranged with tube 80 to form a head-end pressure chamber 86 and a rod-end pressure chamber 88. Head- and rod-end pressure chambers 86, 88 may each be selectively supplied with pressurized fluid and drained of the pressurized fluid to cause piston assembly 82 and connected rod 84 to displace within tube 80, thereby changing an effective length of hydraulic cylinders 26, 28, 34, 36, 44, 48. A flow rate of fluid into and out of head- and rod-end pressure chambers 86, 88 may relate to a velocity of the cylinders, while a pressure differential between head- and rod-end pressure chambers 86, 88 may relate to a force imparted by the cylinders on work tool 14.

Machine 10 may include a hydraulic system 90 having a plurality of fluid components that cooperate to cause the extending and retracting movements of hydraulic cylinders 26, 28, 34, 36, 44, 48 described above. Specifically, hydraulic system 90 may include a tank 92 holding a supply of fluid, and a pump 94 configured to pressurize the fluid and selectively direct the pressurized fluid to each of hydraulic cylinders 26, 28, 34, 36, 44, 48. Pump 94 may be connected to tank 92 via a tank passage 96, and to each of hydraulic cylinders 26, 28, 34, 36, 44, 48 via a common supply passage 98 and separate head- and rod-end passages 100, 102. Tank 92 may be connected to each of hydraulic cylinders 26, 28, 34, 36, 44, 48 via a common drain passage 104 and head- and rod-end passages 100, 102. Hydraulic system 90 may also include a plurality of valves located between hydraulic cylinders 26, 28, 34, 36, 44, 48 and tank 92 and pump 94 to regulate flows of fluid through passages 98-104.

The valves of hydraulic system 90 may be disposed within a common or separate valve blocks (not shown) and include, for example, a first valve 106 associated with lift cylinders 26 and 28, and a second valve 108 associated with yaw cylinders 34 and 36, a third valve 110 associated with pitch cylinder 44, and a fourth valve 112 associated with roll cylinder 48. Each of valves 106-112 may be disposed between the head- and rod-end passages 100, 102 of the corresponding cylinder(s) and common supply and drain passages 98, 104, and take any configuration known in the art (e.g., pilot operated, electro-hydraulic, and/or solenoid operated configurations). Regardless of the configuration of valves 106-112, an element associated with each valve may be movable between a first position at which a main flow of pressurized fluid from common supply passage 98 is allowed to pass to head-end pressure chamber 86 of its associated hydraulic cylinder(s) and waste fluid from rod-end pressure chamber 88 is allowed to pass to common drain passage 104, and a second position at which the main flow of pressurized fluid from common supply passage 98 is allowed to pass to rod-end pressure chamber 88 and waste fluid from head-end pressure chamber 86 is allowed to pass to common drain passage 104. In some embodiments, the valve element may also be moveable to a third position, at which fluid flow between the different passages is inhibited. In these embodiments, the valve element may be spring-biased toward the third position and urged to any position between the third and first or third and second positions based on a command signal. It is contemplated that additional components may be associated with valves 106-112 and/or hydraulic system 90, if desired, such as pressure compensating valves, check valves, pressure relief valves, pressure regulating valves, load sensing valves, resolvers, etc.

A controller 114 may be in communication with the different components of hydraulic system 90 and configured to generate the valve command signals discussed above in response to operator input received via input device 56. For example, based on the signals generated by input device 56 during pivoting of handle 60 and manipulation of control elements 72 and 74, controller 114 may be configured to selectively activate different combinations of valves 106-112 to efficiently carry out operator commands.

Controller 114 may include a memory, a secondary storage device, a clock, and one or more processors that cooperate to accomplish a task consistent with the present disclosure. Numerous commercially available microprocessors can be configured to perform the functions of controller 114. It should be appreciated that controller 114 could readily embody a general machine controller capable of controlling numerous other functions of machine 10. Various known circuits may be associated with controller 114, including signal-conditioning circuitry, communication circuitry, and other appropriate circuitry. It should also be appreciated that controller 114 may include one or more of an application-specific integrated circuit (ASIC), a field-programmable gate array (FPGA), a computer system, and a logic circuit configured to allow controller 114 to function in accordance with the present disclosure.

INDUSTRIAL APPLICABILITY

The disclosed input device may be used with any machine having a work tool that is capable of movement in multiple directions. The disclosed input device may be particularly useful when applied to a dozer having a blade where independent control over lifting, pitching, rolling, and yawing is beneficial. Independent control over blade lifting, pitching, rolling, and yawing may be possible through separate regulation of independent hydraulic cylinders under the direction of a machine operator. Operation of input device 56, in connection with hydraulic system 90, will now be described in detail.

As shown in FIG. 4, each of hydraulic cylinders 26, 28, 34, 36, 44, 48 may be movable by fluid pressure. In particular, fluid may be drawn from tank 92, pressurized by pump 94, and selectively directed to control valves 106-112 via common supply passage 98. In response to an operator manipulation of input device 56, controller 114 may selectively generate a command that causes one or more of control valves 106-112 to move toward a desired position at which the main flow of pressurized fluid is directed to the appropriate one of head- and rod-end pressure chambers 86, 88. Substantially simultaneously, the same valve movement may communicate the other of head- and rod-end pressure chambers 86, 88 of the same cylinder with tank 92 via common drain passage 104, thereby creating a force differential across piston assembly 82 that causes piston assembly 82 to move.

For example, if lifting of work tool 14 is requested by the operator through pivoting of handle 60 in a rearward direction (i.e., through pulling of handle 60 backward toward the operator) about axis 66, a corresponding signal may be generated by input device 56 and directed to controller 114. In response to receiving this signal, controller 114 may generate a command directed to control valve 106, causing rod-end chambers 88 of lift cylinders 26, 28 to fill with pressurized fluid and retract piston assemblies 82. This retraction may function to raise push frame 22, along with work tool 14. In contrast, if lowering of work tool 14 is requested by the operator through pivoting of handle 60 in a forward direction (i.e., through pushing of handle 60 away from the operator), a corresponding signal may be generated by input device 56 and directed to controller 114. In response to receiving this signal, controller 114 may generate a command directed to control valve 106, causing head-end chambers 88 of lift cylinders 26, 28 to fill with pressurized fluid and extend piston assemblies 82. This extension may function to lower push frame 22, along with work tool 14.

Similarly, if counterclockwise rolling (when viewed from an operator's perspective) of work tool 14 is requested by the operator through pivoting of handle 60 to the left about axis 68, a corresponding signal may be generated by input device 56 and directed to controller 114. In response to receiving this signal, controller 114 may generate a command directed to control valve 112, causing rod-end chambers 88 of roll cylinder 48 to fill with pressurized fluid and retract piston assembly 82. In contrast, if clockwise rolling of work tool 14 is requested by the operator through pivoting of handle 60 to the right, a corresponding signal may be generated by input device 56 and directed to controller 114. In response to receiving this signal, controller 114 may generate a command directed to control valve 112, causing head-end chamber 88 of roll cylinder 48 to fill with pressurized fluid and extend piston assembly 82.

If counterclockwise yawing (when viewed from a top-down perspective) of work tool 14 is requested by the operator through pivoting of control element 72 to the left about axis 78, a corresponding signal may be generated by input device 56 and directed to controller 114. In response to receiving this signal, controller 114 may generate a command directed to control valve 108, causing rod-end chamber 88 of yaw cylinder 34 to fill with pressurized fluid and retract piston assembly 82, and/or causing head-end chamber 86 of cylinder 36 to fill with pressurized fluid and extend piston assembly 82. In contrast, if clockwise yawing of work tool 14 is requested by the operator through pivoting of control element 72 to the right, a corresponding signal may be generated by input device 56 and directed to controller 114. In response to receiving this signal, controller 114 may generate a command directed to control valve 108, causing head-end chamber 88 of yaw cylinder 34 to fill with pressurized fluid and extend piston assembly 82, and/or causing rod-end chamber 86 of cylinder 36 to fill with pressurized fluid and retract piston assembly 82.

If forward pitching of work tool 14 is requested by the operator through pivoting of control element 72 forward about axis 76, a corresponding signal may be generated by input device 56 and directed to controller 114. In response to receiving this signal, controller 114 may generate a command directed to control valve 110, causing head-end chamber 86 of pitch cylinder 44 to fill with pressurized fluid and extend piston assembly 82. In contrast, if rearward pitching of work tool 14 is requested by the operator through pivoting of control element 72 rearward, a corresponding signal may be generated by input device 56 and directed to controller 114. In response to receiving this signal, controller 114 may generate a command directed to control valve 110, causing rod-end chamber 86 of pitch cylinder 44 to fill with pressurized fluid and retract piston assembly 82.

Shaking of work tool 14 may be initiated in a similar manner. In particular, an operator may request initiation of work tool shaking by depressing one or more of momentary control elements 74. When momentary control element(s) 74 are depressed, corresponding signals may be generated by input device 56 and directed to controller 114. In response to receiving these signals, controller 114 may selectively command one or more of control valves 106-112 (e.g., control valve 110) to rapidly fill and drain head- and rod-end chambers 86, 88 of the associated cylinders (e.g., of pitch cylinder 44). This may result in rapid extension/retraction oscillation of piston assembly 82 and shaking of work tool 14.

The disclosed input device may be intuitive and include enhanced functionality. In particular, each of the movements of input device 56 may generally align with the resulting movements of work tool 14. For example, forward tilting of handle 60 may generally align with lowering of work tool 14, while leftward tilting of handle 60 may generally align with counterclockwise rolling. Similarly, forward tilting of proportional control element 72 may generally align with the forward pitching of work tool 14, while leftward tilting of proportional control element 72 may generally align with counterclockwise yawing of work tool 14. And the tilt angle of handle 60 and control element 72 may be generally proportional to a resulting speed of work tool 14. This may make control of work tool 14 simple and easy to use. Further, because all work tool controls may be co-located within a single input device, the operator may need to expend little effort during use of work tool 14, and the operator may be better able to focus on the task at hand.

It will be apparent to those skilled in the art that various modifications and variations can be made to the input device of the present disclosure without departing from the scope of the disclosure. Other embodiments will be apparent to those skilled in the art from consideration of the specification and practice of the input device disclosed herein. It is intended that the specification and examples be considered as exemplary only, with a true scope of the disclosure being indicated by the following claims and their equivalent.

What is claimed is:

1. An input device for a machine having a work tool, the input device comprising:

a handle having a proximal end connectable to the machine, and a distal end; and a proportional control element located at the distal end of the handle, the proportional control element being configured to:

pivot in a first direction to generate a first signal, and pivot in a second direction, generally orthogonal to the first direction, to generate a second signal, wherein:

the first signal is indicative of a desire to pitch the work tool about a first axis of rotation, the first axis of rotation being generally horizontal relative to a ground surface under the machine and generally perpendicular relative to a travel direction of the machine; and the second signal is indicative of a desire to yaw the work tool about a second axis of rotation, the second axis of rotation being generally vertical relative to the ground surface and generally perpendicular relative to the first axis.

2. The input device of claim 1, wherein the proportional control element is biased to a neutral position in both the first and second directions.

3. The input device of claim 1, wherein the proportional control element is a rocker button.

4. The input device of claim 1, wherein the handle is configured to pivot in a third direction to generate a third signal indicative of a desire to change an elevation of the work tool.

5. The input device of claim 4, wherein:

the handle is configured to pivot in a fourth direction generally orthogonal to the third direction to generate a fourth signal indicative of a desire to roll the work tool about a third axis of rotation that is generally aligned with the travel direction of the machine and generally perpendicular to the first axis of rotation and the second axis of rotation.

6. The input device of claim 5, wherein the handle is biased to a neutral position in both the third and fourth directions.

7. The input device of claim 5, wherein the handle is oriented at an angle relative to the third and fourth directions.

8. The input device of claim 1, further including a first momentary control element configured to generate a third signal indicative of a desire to shake the work tool.

9. The input device of claim 8, further including at least a second momentary control element configured to generate a fourth signal associated with a tracked grading operation of the work tool.

10. The input device of claim 9, wherein the proportional control element is located gravitationally lower than the first and the at least a second momentary control elements.

11. The input device of claim 1, wherein the proportional control element is configured to pivot in a direction between the first and second directions to generate a composite signal indicative of a desire to simultaneously pitch and yaw the work tool.

12. An input device for a machine having a work tool, the input device comprising:

a handle having a proximal end connectable to the machine and a distal end, the handle being configured to pivot in a first direction to generate a first signal and to pivot in a second direction, generally orthogonal to the first direction, to generate a second signal;

a rocker button located at the distal end of the handle, and the rocker button being configured to pivot in a third direction to generate a third signal and to pivot in a fourth direction, generally orthogonal to the third direction, to generate a fourth signal, wherein:

the second signal is indicative of a desire to elevate the work tool relative to the ground surface;

the third signal is indicative of a desire to pitch the work tool about a first axis of rotation that is generally horizontal relative to a ground surface under the machine and generally perpendicular relative to a travel direction of the machine;

the fourth signal is indicative of a desire to yaw the work tool about a second axis of rotation that is generally vertical relative to the ground surface and generally perpendicular relative to the first axis; and the first signal is indicative of a desire to roll the work tool about a third axis of rotation that is generally horizontal relative to the ground surface and generally perpendicular relative to the first axis and the second axis.

13. The input device of claim 12, further including a first momentary button configured to generate a fifth signal indicative of a desire to shake the work tool.

14. The input device of claim 13, further including at least a second momentary button configured to generate a fifth signal associated with a tracked grading operation of the work tool, wherein the rocker button is located gravitationally lower than the first and the at least a second momentary buttons.

15. The input device of claim 13, wherein the rocker button is configured to further pivot in a direction between the first and second directions to generate a composite signal indicative of a desire to simultaneously pitch and yaw the work tool.

16. A machine, comprising:

a machine frame;

a work tool pivotally connected to the machine frame;

at least a first cylinder configured to elevate the work tool relative to the machine frame;

at least a second cylinder configured to yaw the work tool relative to the machine frame;

a third cylinder configured to pitch the work tool relative to the machine frame;

a fourth cylinder configured to roll the work tool relative to the machine frame;

an operator station supported by the machine frame; and an input device located inside the operator station and including:

a handle having a proximal end connectable to the machine and a distal end, and being configured to pivot in a first direction to generate a first signal indicative of a desire to actuate the at least a first cylinder and to pivot in a second direction generally orthogonal to the first direction to generate a second signal indicative of a desire to actuate the fourth cylinder; and a rocker button located at the distal end of the handle, and configured to pivot in a third direction to generate a third signal indicative of a desire to actuate the at least a second cylinder and to pivot in a fourth direction generally orthogonal to the third direction to generate a fourth signal indicative of a desire to actuate the third cylinder.

17. The machine of claim 16, further including a controller in communication with the input device and each of the at least a first cylinder, the at least a second cylinder, the third cylinder, and the fourth cylinder.

18. The machine of claim 16, further including a generally C-shaped push frame pivotally connecting a lower edge of the work tool to the machine frame, wherein the at least a first cylinder includes two cylinders, each connecting a leg of the generally C-shaped push to the machine frame.

19. The machine of claim 18, wherein the at least a second cylinder includes two cylinders, each connecting a side edge of the work tool to the generally C-shaped push frame.

20. The machine of claim 19, wherein:

the C-shaped push frame includes an arm extending toward an upper edge of the work tool;

the third cylinder connects the upper edge of the work tool to the arm; and the fourth cylinder oriented generally orthogonal to the third cylinder and connecting the arm to a point of the work tool between the arm and the side edge.

* * * * *